United States Patent [19]

Daikoku et al.

[11] 4,298,825

[45] Nov. 3, 1981

[54] MAGNETRON DEVICE

[75] Inventors: Takahiro Daikoku, Ibaraki; Tomokatsu Oguro, Mobara, both of Japan

[73] Assignee: Hitachi, Ltd., Tokyo, Japan

[21] Appl. No.: 48,063

[22] Filed: Jun. 13, 1979

[30] Foreign Application Priority Data

Jun. 16, 1978 [JP] Japan ..... 53-81879[U]

[51] Int. Cl.[3] ..... H01J 25/50

[52] U.S. Cl. ..... 315/39.51; 165/47; 313/40; 313/45

[58] Field of Search ..... 315/39.51, 39.75, 39.77, 315/39.53; 313/40, 45; 165/47

[56] References Cited

U.S. PATENT DOCUMENTS

| | | | |
|---|---|---|---|
| 2,431,157 | 11/1947 | Zelinka | 313/45 X |
| 2,464,735 | 3/1949 | Vanderweil | 165/47 X |
| 3,038,703 | 6/1962 | Deakin | 165/47 |
| 3,095,037 | 6/1963 | Bohm | 313/45 X |
| 3,377,562 | 4/1968 | Staats | 315/39.51 X |
| 3,967,154 | 6/1976 | Tashiro et al. | 315/39.51 |
| 4,039,892 | 8/1977 | Kerstens | 315/39.51 |
| 4,163,175 | 7/1979 | Tashiro | 315/39.51 |

FOREIGN PATENT DOCUMENTS

| | | | |
|---|---|---|---|
| 964265 | 7/1964 | United Kingdom | 313/40 |

*Primary Examiner*—Saxfield Chatmon, Jr.
*Attorney, Agent, or Firm*—Charles E. Pfund

[57] ABSTRACT

In a forced air cooled type magnetron device having a plurality of cooling fins, the opposite ends of each fin are provided with a plurality of tongue shaped pieces and alternate pieces are bent in the opposite directions to enhance turbulence.

7 Claims, 7 Drawing Figures

MAGNETRON DEVICE

BACKGROUND OF THE INVENTION

This invention relates to a forced air cooled type magnetron device in which the configuration of the cooling fins is improved for enhancing cooling effect and which is suitable for mass-production.

Most of the presently used magnetrons are contained in an air duct disposed substantially perpendicular to the axis of magnetron and having a square cross-section for effecting forced cooling. However, it has been desired to develop improved cooling fins having higher cooling efficiency and being easy to manufacture.

With the conventional flat plate type cooling fin, at the corners of the square air duct no fin is present so that air flowing through these portions does not contribute to the cooling. To solve this problem and for the purpose of dissipating the heat generated during the operation of a magnetron, it has already been proposed to use an improved construction of the cooling fins in which fins near the opposite ends of the magnetron tube are bent at larger angles than those at the intermediate portion so that the spacings between the outer ends of adjacent fins are made to be larger near the opposite ends than the spacings between those at the intermediate portion and in which the outer ends of the cooling fins are present also at the corners of the duct, as disclosed in Japanese Utility Model Application Laid-Open No. 28954/1976. This construction, however, increases the number of types of the cooling fin so that it is not suitable for mass production.

SUMMARY OF THE INVENTION

It is therefore an object of this invention to provide an improved forced air cooled type magnetron device provided with improved cooling fins having a high cooling efficiency and a unique construction suitable for mass-production.

According to this invention there is provided a magnetron device comprising a plurality of cooling fins secured to the periphery of a magnetron tube to extend in a direction substantially perpendicular to the axis of the tube and means for blasting cooling air passed through the cooling fins in a direction perpendicular to the tube axis, wherein each of the cooling fins comprises a flat portion fitted to said tube and a plurality of tongue shaped pieces on the opposite sides of the flat portion, and wherein alternate tongue shaped pieces on each side extend in different directions with respect to the flat portion so that the tongue shaped pieces of adjacent cooling fins intersect with each other for enhancing turbulence.

One group of alternate tongue shaped pieces is bent upwardly, while the other downwardly or coextensive with the flat portion. To further enhance the turbulence the tongue shaped pieces may be twisted.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1A:
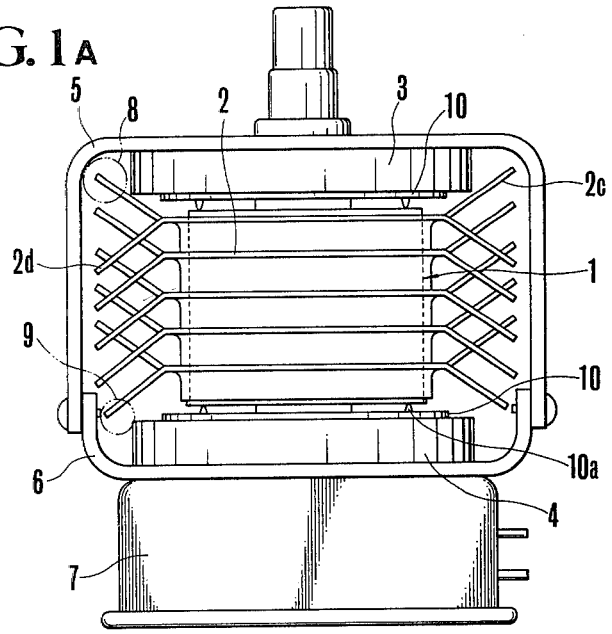
FIG. 1A is a front view showing a magnetron device embodying the invention.

As is well known in the art, a magnetron tube 1 shown in FIG. 1A comprises a cathode electrode at its axial center, an anode electrode surrounding the cathode electrode with an interaction space therebetween, and split anode electrode segments connected to the inner surface of the anode cylinder surrounding the cathode electrode to form a high frequency oscillator. To dissipate the heat generated by the operation of the magnetron tube 1, a plurality of cooling fins 2 are secured to the outer surface of the magnetron tube. The magnetron tube further includes permanent magnets 3 and 4 for creating magnetic field in the interaction space and in the axial direction of the tube, yokes 5 and 6 which form outer magnetic path and a portion of a cooling air duct, a filter case 7 containing a filter (not shown) which prevents high frequency power from flowing back to a source. Reference numerals 8 and 9 denote corner areas in the air duct at the opposite ends of the permanent magnets. The permanent magnets 3 and 4 are provided with ferromagnetic rings 10 having projections **10*a*** for concentrating the magnetic flux, and for preventing conduction of heat to the magnets from the magnetron body, this construction being disclosed in Japanese Patent Application Laid-Open No. 108,960/1974.

Figure 1B:
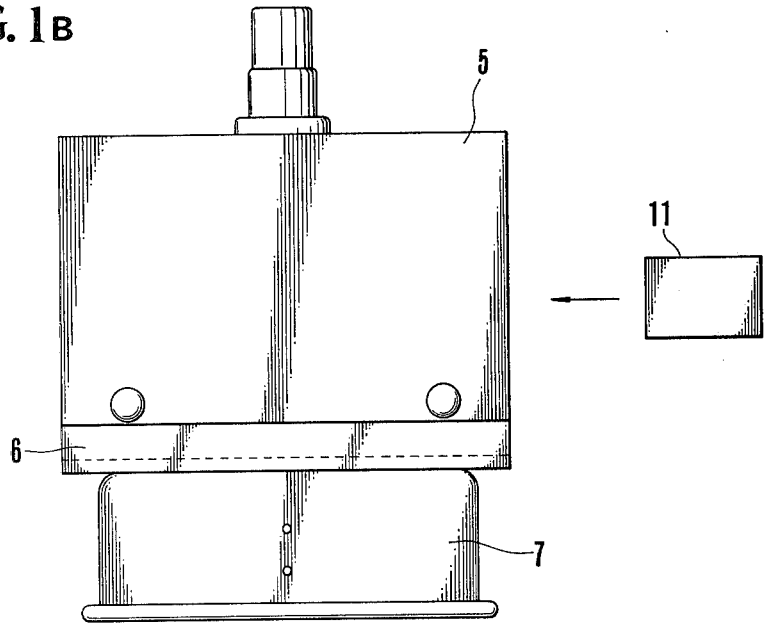
FIG. 1B is a side view of the magnetron device showing in particular positional relationship between the magnetron and a forced air source.

As shown in FIG. 1B, a forced air source 11 is placed near the magnetron to blast air flow shown by arrow into the air duct. The air flow is partly blocked by the permanent magnets 3 and 4 and directed toward the corner areas 8 and 9.

Figure 2:
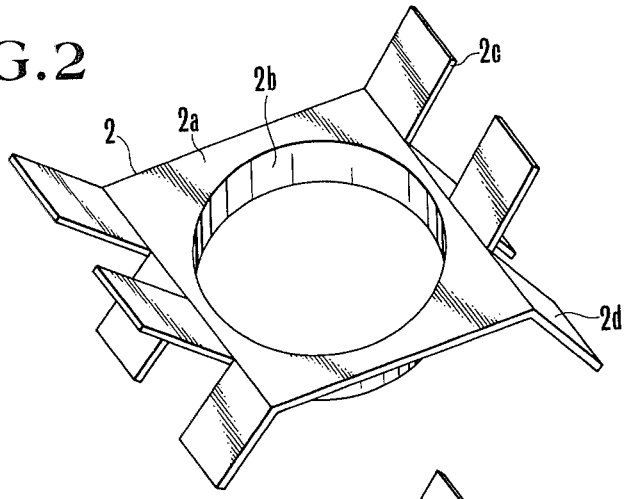
FIGS. 2 to 6 are perspective views showing various modifications of the cooling fins constructed according to the teaching of this invention.
Figure 3:
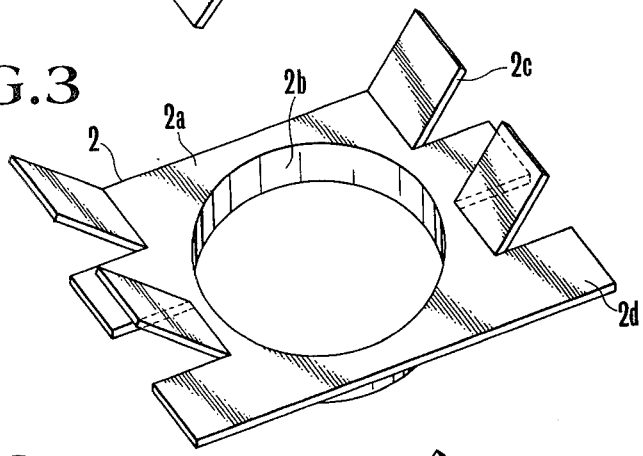
Figure 4:
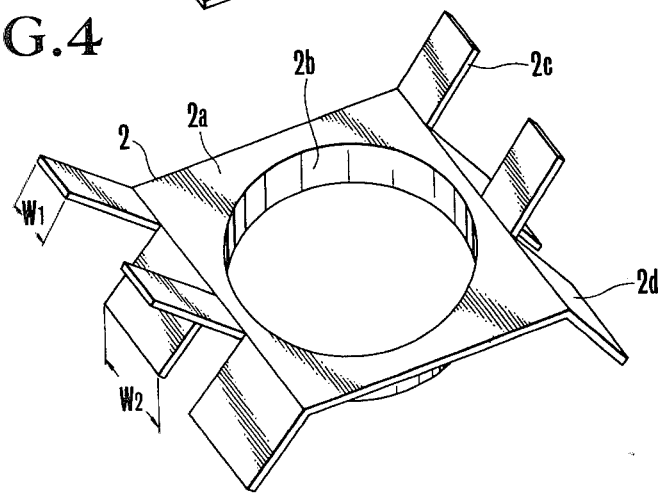
Figure 5:
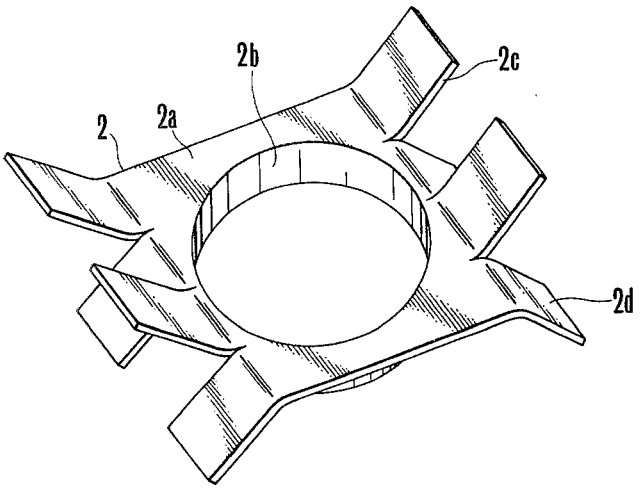
Figure 6:
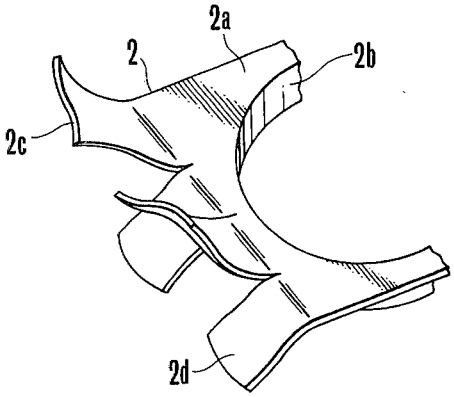

FIG. 2 shows one example of the cooling fin 2 embodying the invention, which comprises a flat portion **2*a*, a circular opening 2*b* with a flange to which the magnetron tube 1 is force fitted and tongues 2*c* and 2*d* which are alternately bent upwardly and downwardly with respect to the flat portion 2*a*. As best shown in FIG. 1, inclined tongues 2*c* and 2*d* of adjacent cooling fins intersect with each other. As can be noted from FIG. 1, the spacing between the outer ends of the tongues of the lowermost cooling fin and the inner surface of the air duct is small so that once the direction of the lowermost cooling fin is determined with respect to the direction of the air duct, the direction of mounting upper succeeding cooling fins is automatically determined. Thus, so-called self-jigging can be made. Since the tongues are bent as described above, the outer ends of the tongues of the cooling fins can extend into the corner portions 8 and 9** of the air duct. The air flows passing through these corner portions are relatively cool but cannot be utilized effectively for effecting cooling in the prior art construction. When the tongues of the cooling fins are bent in the opposite directions to cross each other, it is possible not only to increase the contact area with the cooling air but also to induce turbulent flow of the air, thus increasing the cooling effect thereof. Moreover, as the resistance of the ends of the cooling fins to the air flow increases, a larger proportion of the air flows near the periphery of the magnetron tube, thus greatly enhancing the cooling effect.

As can be noted from FIG. 1 all cooling fins have the same construction, so that they are suitable for mass-production.

As described above, the cooling fins of this invention increase the cooling effect of a magnetron tube cooled by air flowing across the tube with the result that where a cooling fan of the same capacity as in the conventional design is used, the temperature of the anode can be decreased, thus increasing its life and decreasing temperature drift. Conversely, for the same operating life as in the conventional design, it is possible to decrease the capacity of the cooling fan thus reducing the cost of manufacturing. Only one type of the cooling fin and the advantageous feature of the self-jigging facilitate mass-production of the magnetron tube.

FIGS. 3 to 6 show modified constructions of the cooling fins. More particularly, in the construction shown in FIG. 3, alternate tongues are bent upwardly (*2c*) while others extend in the horizontal direction (*2d*). In another modification shown in FIG. 4, the width W1 of the upwardly bent tongues *2c* is made to be different from the width W2 of the downwardly bent tongues *2d*. In the case shown in FIG. 5, the tongues *2c* and *2d* are not bent sharply with respect to the flat portion *2a* but with a slight curvature at the bends, the curvatures of respective bends may be or may not be the same. In yet another modification shown in FIG. 6 the tongues are twisted to increase the turbulence.

What is claimed is:

1. In a magnetron device comprising a plurality of cooling fins stacked and secured to the periphery of a magnetron tube to extend in a direction substantially perpendicular to the axis of said tube and means for blasting cooling air passed through said cooling fins in a direction substantially perpendicular to said tube axis, the improvement wherein each of said cooling fins comprises a flat portion fitted to said tube and a plurality of tongue shaped pieces on the opposite sides of said flat portion, and alternate tongue shaped pieces on each side extend in different directions with respect to the plane of said flat portion so that said tongue shaped pieces of adjacent cooling fins are interdigitated to intersect with each other to define a plurality of contiguous parallel passages aligned in the direction of air flow for enhancing turbulence.

2. An improvement according to claim 1 wherein alternate tongue shaped pieces on each side of said flat portion are bent in different directions with respect thereto.

3. An improvement according to claim 1 wherein alternate ones of said tongue shaped pieces are bent upwardly whereas remaining tongue shaped pieces are bent downwardly with respect to said flat portion.

4. An improvement according to claim 1 wherein alternate ones of said tongue shaped pieces are bent at an angle with respect to said flat portion whereas remaining tongue shaped pieces are coextensive with said flat portion.

5. An improvement according to claim 1, 2, 3 or 4 wherein said tongue shaped pieces have different width.

6. An improvement according to claim 1, 2, 3, 4 or 5 wherein said tongue shaped pieces are twisted.

7. An improvement according to claim 1 wherein said tongue shaped pieces are connected to said flat portion through rounded portions.

* * * * *